United States Patent [19]

Goodall

[11] Patent Number: 4,809,870

[45] Date of Patent: Mar. 7, 1989

[54] INSERTS FOR FIXING INTO OPENINGS

[76] Inventor: Donald T. Goodall, 30 Beach Street, Blakehurst NSW 2220, Australia

[21] Appl. No.: 123,061

[22] PCT Filed: Dec. 5, 1986

[86] PCT No.: PCT/AU86/00375

§ 371 Date: Oct. 8, 1987

§ 102(e) Date: Oct. 8, 1987

[87] PCT Pub. No.: WO87/03559

PCT Pub. Date: Jun. 18, 1987

[30] Foreign Application Priority Data

Dec. 6, 1985 [AU] Australia ..... PH3773

[51] Int. Cl.[4] ..... B65D 41/04

[52] U.S. Cl. ..... 220/288; 220/855 P; 222/568; 222/569

[58] Field of Search ..... 220/288, 855 P; 222/567, 568, 569, 570

[56] References Cited

U.S. PATENT DOCUMENTS

| | | | |
|---|---|---|---|
| 2,900,103 | 8/1959 | Taylor, III et al. | 220/288 |
| 2,916,311 | 12/1959 | Keplinger | 220/288 |
| 4,105,135 | 8/1978 | Bradshaw et al. | 220/288 |
| 4,422,563 | 12/1983 | Babiol | 222/153 |
| 4,632,282 | 12/1986 | Nagashima | 222/529 |

FOREIGN PATENT DOCUMENTS

| | | |
|---|---|---|
| 204587 | 1/1955 | Australia . |
| 1444196 | 7/1975 | United Kingdom . |

*Primary Examiner*—George T. Hall

*Attorney, Agent, or Firm*—Dann, Dorfman, Herrell and Skillman

[57] ABSTRACT

Insert (1) for fixing into openings, the insert being manufactured in at least two parts having openings therethrough, the parts being joined together so as the openings are in communication. One cap member (2) and at least one locking member (3) are required to form an insert, whereby the cap member interfaces with the external surrounding suface of an opening and the locking member interfaces with the internal surrounding surface of an opening so as to fixedly locate the assembled insert within the opening and cause both the insert and the opening to flex to a certain extent, whereby the insert is snugly fitted in the opening and any movement between the insert and the opening is accommodated by flexural movement of either or both the insert and/or the opening without affecting the seal between them. The insert may be directed towards the sealing of liquids within containers, the removal of liquids from containers, a combination of the sealing in and removal of liquid from containers or the joining of tubular members.

17 Claims, 3 Drawing Sheets

INSERTS FOR FIXING INTO OPENINGS

The present invention relates to inserts for fixing into openings and while not limited thereto is particularly suitable for fixing into openings in plastic containers.

Containers are usually formed of a container body having an opening therein in which is fitted a neck member which communicates with the interior of the container, the neck member being provided with an internal or external thread which accommodates a cap or plug whereby the opening in the neck is closed to seal the contents within the container, or a pouring spout for the removal of the contents of a container with reduced spillage.

In the case of metal containers the manufacture of the neck member integral with the container wall has proved costly and if the neck member is manufactured as a separate component its sealing in an opening of the container has proved difficult. In consequence it has been proposed to manufacture inserts for containers from plastic materials and in this case the insert is simply force fitted into an opening in the container and the seal between the insert is effected by a radial sealing force exerted by the insert on the edge of the opening in the container which accommodates the insert.

In use there is a tendancy for such inserts to move longitudinally in the container opening. This movement is caused by loadings imposed on the container e.g. by rough handling and in some cases such movement breaks the seal between the container opening and the insert thereby causing the container to leak.

The present invention according to one aspect provides an insert for a container which overcomes such problems, from another aspect provides a container which includes such an insert and from a further aspect provides for the joining of two tubular members by said insert.

A preferred embodiment of the invention will now be described with reference to the accompanying drawings in which FIG. 1 is a perspective view of an insert in accordance with the invention;

Figure 1:
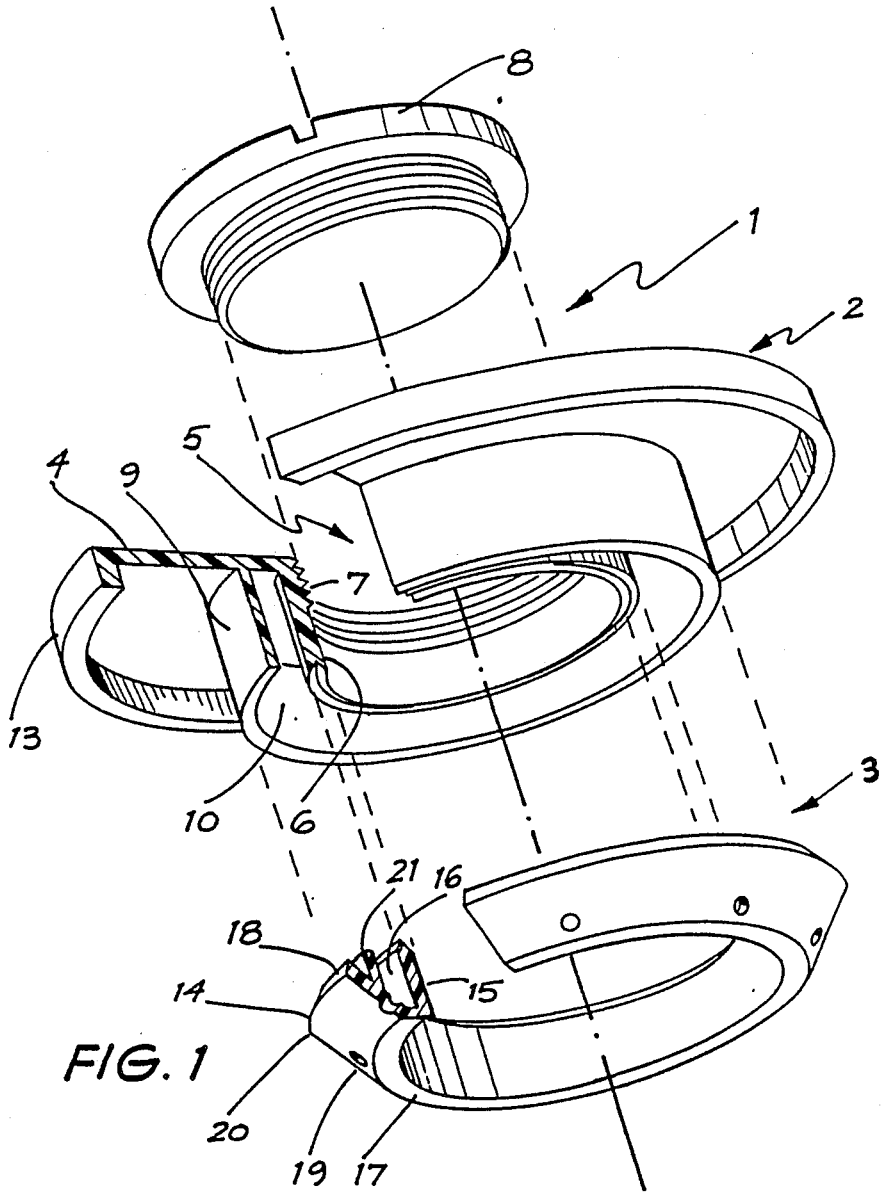

Referring now to the drawings the insert 1 is manufactured in two parts namely the cap member 2 and the locking member 3. The cap member 2 is formed of a circular disc 4 having an opening 5 therein, a first integral cylindrical sleeve 6 extends inwardly from the periphery of the opening and defines the neck of the insert, the internal wall of the sleeve is threaded as at 7 to accommodate a plug 8. In certain applications the insert may be formed with a rupturable membrane (not shown) secured across the bottom end of the neck.

Extending from the disc 4 is a second integral sleeve 9 spaced radially outwardly from the first sleeve 6 and defining with these sleeves a cavity 10. The sleeve 9 is slightly longer than the sleeve 6 and has an inset portion forming a channel 11 which is formed in sleeve 9 by compression of the locking rim 28 which is prevented from rolling inwards when compressed by the locking rim 28 by an extension of the sleeve 9 which is used to form the cavity 16 as shown in FIG. 4 and a tongue 12, the purpose of which will be explained hereafter.

A flange 13 which is adapted to seat on an outer wall of the container extends downwardly from the disc.

The locking member 3 comprises a ring shaped member having two limbs 14 and 15 defining therebetween a cavity 16 which is in communication with the internal pressure of the container via at least one hole formed in the bottom edge 17. The limb 15 extends in a plane normal to the plane of the bottom edge 17 of the ring and the wall of the limb 14 is angled as at 18 and 19 from a position 20 to join the bottom edge of the ring member and thereby forming a nosing to facilitate the insertion of an assembled insert in a container, the inner end of the limb 14 is formed with a channel 21 therein.

Figure 4:
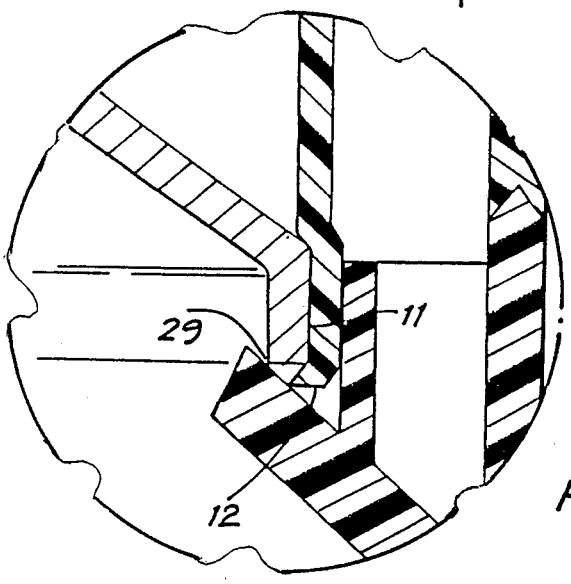
FIG. 4 is an enlarged view showing the method of locking the insert in the container.
Figure 5:
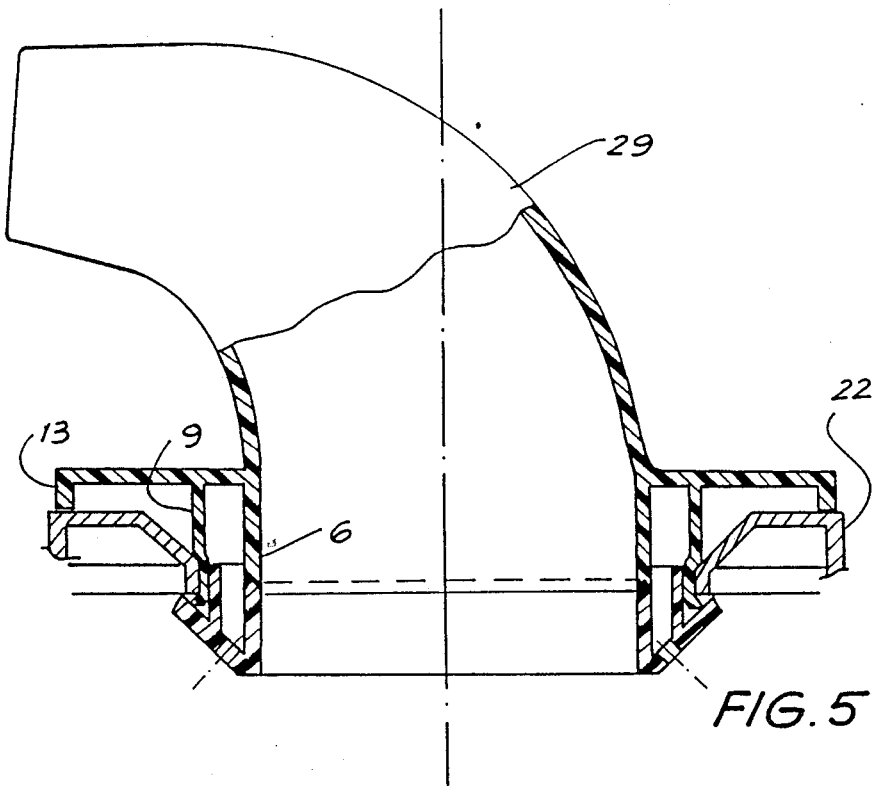
FIG. 5 is a cross-sectional view showing the insert with an integral pouring spout.

The respective components, namely the cap member 2 and the locking member 3, are assembled together with the limb 15 secured to sleeve 6 by sonic welding and the tongue 12 seating in the channel 16 as illustrated in FIG. 4. It will be appreciated that the respective components may be secured together by other means e.g. with the aid of adhesives or by forming the mentioned components with interlocking sections as is well understood in the art, which sections snap fit one within the other to form a unitary structure.

When the insert is in the assembled condition, the cavity 10 registers with the cavity 16, the limbs 6 and 15 form inner wall of the insert and the limbs 9 and 14 form the outer wall of the insert.

The container wall 22 has a cylindrical opening 23 therein. The wall is bent upwardly as at 24 inwardly as at 25 thereby defining a seat for the flange 13 of the insert then inwardly and downwardly at an acute angle as at 26 and then downwardly as at 27 thereby defining a locking rim designated generally by the reference 28.

Figure 2:
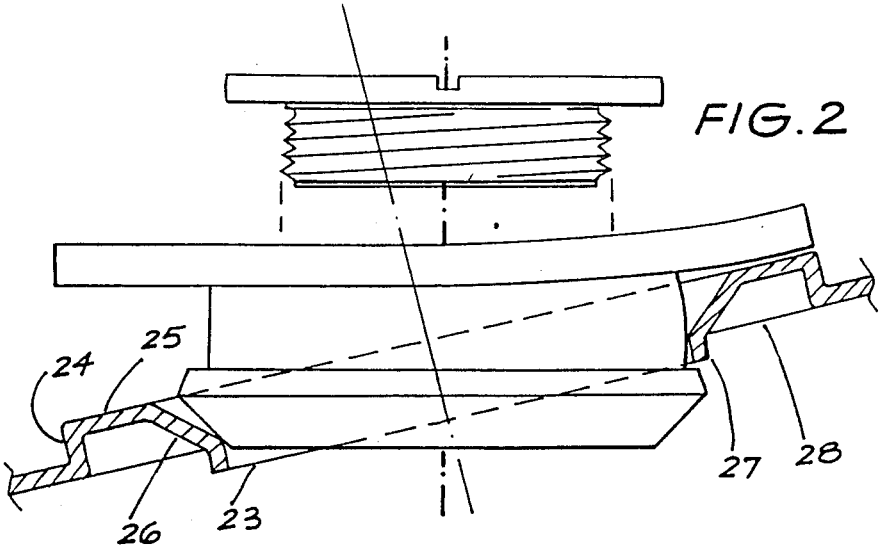
FIG. 2 is a cross-sectional view showing the method of fitting the insert in a container.
Figure 3:
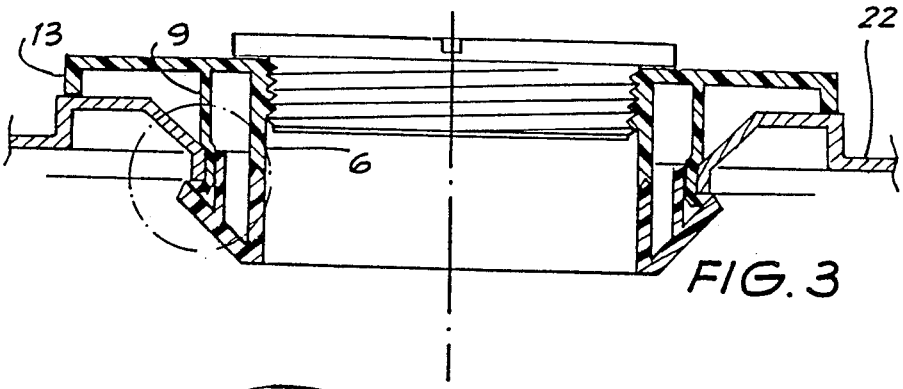
FIG. 3 is a cross-sectional view showing the insert fitted in the container.

The diameter of the sleeve 9 is slightly larger than the opening 23 in the container. The insert is inserted in the opening 23 in the manner illustrated in FIG. 2, the container and the insert both are flexed to a certain extent whereby the insert is snuggly fitted in the opening, in this position the locking rim 28 forms the channel 11 with a bottom edge of the rim seating on the top edge 29 of the member 3 and the flange 13 on the surface 25.

The construction of the insert and the method of its connection in the opening in a container is such that any movement between the insert and the container is accommodated by flexure of the drum and/or the insert without effecting the seal between the respective components.

The insert may be more appropriately directed to the removal of liquid from a container by the replacement of the threaded portion 7 and the plug 8 with an integrally attached pouring spout 29.

Figure 6:
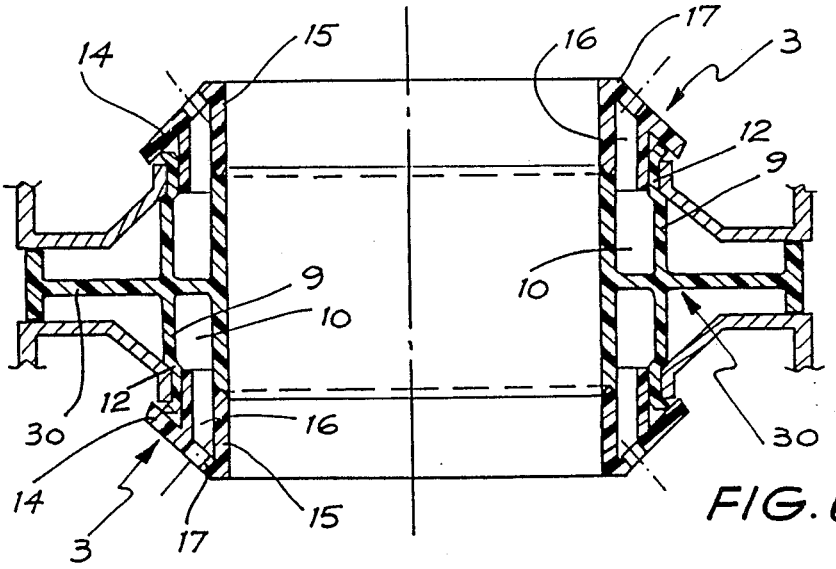
FIG. 6 is a cross-sectional view showing the insert used to connect two tubular members.

Referring to FIG. 6 the insert may be manufactured in three parts namely an extended cap member 30 and two locking members 3 to facilitate the joining of tubular members. The extended cap member 30 is formed of a circular disc 4 having an opening therein, a first integral cylindrical sleeve to extending equally inwardly and outwardly from the periphery of the opening and defining the neck of the insert.

Extending from the disc 4 both inwardly and outwardly are second integral sleeves 9 spaced radially outwardly from the first sleeve 6 and defining with these sleeves cavities 10. The sleeves 9 are slightly longer than the sleeve 6 and have inset portions forming channels 11 which are formed in sleeves 9 by compression of the locking rims 28 which are prevented from rolling inwards when compressed by the locking rims 28 by an extension of the sleeves 9 which are used to form the cavities 16 and a tongue 12. Flanges 13 which are adapted to seat on an outer surface of the tubular members extend downwardly and upwardly from the disc 4.

The locking members 3 assembly procedure and assembled condition being as previously described.

I claim:

1. An insert for fixing into an opening, comprising:

a first member having a cylindrical portion with a passageway therethrough; and a locking member, having a passageway therethrough, said locking member adapted to be fixedly attached to one end of said cylindrical portion of said first member such that in use, said first member extends into and engages in the opening and cooperates with said locking member which lies within the opening, to lock said insert into the opening such that said passageways align and extend through the opening.

2. An insert according to claim 1 wherein said insert has a threaded portion so as to receive an insert to close said passageway.

3. An insert according to claim 1 wherein said insert has a pour spout communicating with said passageway, and extending remote from said cylindrical portion.

4. An insert according to claim 1 wherein there is a second cylindrical portion with a passageway therethrough extending from the first member remote from said first cylindrical portion, such that the passageways of said two cylindrical portions are in communication, said insert being adapted to connect together two pipes whereby in use the first cylindrical portion is locked into the opening of one pipe by means of the locking member, and the second cylindrical portion is locked into the opening of a second pipe by means of a second of the locking members to join said two pipes together.

5. An insert according to claim 1 wherein each cylindrical portion comprises two concentric cylinders disposed one within the other so as to form a cavity therebetween.

6. An insert according to claim 1 wherein the first member is formed of a circular disc having an opening therein and a cylindrical portion concentrically attached thereto and extending inwardly from said disc and defining the neck of the insert.

7. An insert according to claim 1 wherein the outwardly disposed cylinder of the cylindrical portion is longer than the inwardly disposed sleeve.

8. An insert according to claim 1 wherein the neck of the insert may be closed by the attachment of a rupturable membrane across the passageway therethrough.

9. An insert according to claim 1 wherein the locking member comprises an inner sleeve, the inner end of said inner sleeve being integrally attached to a circular lip providing a means by which the insert will securely mate with an internal surface of said opening, said circular lip extending angularly toward said internal surface and to said circular lip being integrally attached a circular ring disposed in a substantially parallel configuration relative to said inner sleeve in such a manner as to be concentrically located within the outwardly disposed cylinder of the cylindrical portion of the first member, an intersection of said circular ring and circular lip forming a groove for the accommodation of said outwardly disposed cylinder.

10. An insert according to claim 1 wherein the first member and locking member are essembled together with the inner sleeve of the locking member secured to the inwardly disposed cylinder of the cylindrical portion of the first member of the cylindrical means.

11. An insert according to claim 10 wherein the inner sleeve of the locking member and the inwardly diposed cylinder of the cylindrical portion of the first member form the insert inner wall, the outwardly diposed cylinder of the cylindrical portion of the first member and the circular ring of the locking member form the outer wall of the insert and the cavity of the first member registers with a cavity of the locking member, said cavity of the locking member being defined by the inner sleeve of said locking member and said circular ring, when the insert is assembled.

12. An insert according to claim 1 wherein the insert is fabricated from a material exhibiting plastic properties.

13. A container for use with the insert wherein a container wall has a cylindrical opening therethrough, said opening having a radial protuberance therein defining a locking rim and an externally raised surface surrounding said opening, said externally raised surface defining a seat for a flange fo the insert.

14. The container as claimed in claim 13 wherein the externally raised surface and locking rim are formed as an integral portion of the container wall.

15. The container as claimed in claim 14, wherein the integral portion of the container wall is formed by a cylindrical ring extending outwardly from said container surface to the inward periphery of the outer end of said cylindrical ring being integrally attached perpendicularly to said ring disc, said disc having an opening therein to which is integrally attached an inwardly diverging conical section to the internal periphery thereof being an integrally attached inwardly extending ring disposed normal to the container surface said inwardly extending ring defining the locking rim and said perpendicular ring defining the externally raised surface.

16. The container as claimed in claim 13 wherein the inside diameter of the locking rim is smaller than the outside diameter of the outwardly disposed cylinder of the cylindrical portion of the first member of insert.

17. The insert according to claim 11 wherein the locking rim of the container forms a channel in outwardly disposed cylinder of the first member thus causing the outwardly disposed cylinder of the insert outer wall to plastrically deform around said locking rim.

* * * * *